US010745226B2

(12) United States Patent
Nakagawa

(10) Patent No.: US 10,745,226 B2
(45) Date of Patent: Aug. 18, 2020

(54) CONVEYANCE MECHANISM

(71) Applicant: TOYO JIDOKI CO., LTD., Tokyo (JP)

(72) Inventor: Atsuo Nakagawa, Yamaguchi-ken (JP)

(73) Assignee: TOYO JIDOKI CO., LTD., Tokyo (JP)

( * ) Notice: Subject to any disclaimer, the term of this patent is extended or adjusted under 35 U.S.C. 154(b) by 160 days.

(21) Appl. No.: 16/110,711

(22) Filed: Aug. 23, 2018

(65) Prior Publication Data

US 2019/0062086 A1 Feb. 28, 2019

(30) Foreign Application Priority Data

Aug. 25, 2017 (JP) ..... 2017-162568

(51) Int. Cl.

| | |
|---|---|
| ***B65G 47/28*** | (2006.01) |
| ***B65H 5/06*** | (2006.01) |
| ***B65H 5/36*** | (2006.01) |
| ***B65B 39/12*** | (2006.01) |
| ***B65B 39/14*** | (2006.01) |

(Continued)

(52) U.S. Cl.

CPC ..... *B65H 5/068* (2013.01); *B65B 7/06* (2013.01); *B65B 37/02* (2013.01); *B65B 37/04* (2013.01); *B65B 37/16* (2013.01); *B65B 39/001* (2013.01); *B65B 39/12* (2013.01); *B65B 39/145* (2013.01); *B65B 43/30* (2013.01); *B65B 43/465* (2013.01); *B65B 43/54* (2013.01); *B65H 5/36* (2013.01); *B65B 51/146* (2013.01); *B65B 61/025* (2013.01); *B65H 2701/191* (2013.01)

(58) Field of Classification Search

CPC ..... B65G 47/28; B65G 47/29; B65G 47/295; B65H 5/068; B65B 37/02; B65B 37/16

USPC ... 198/346.2, 475.1, 468.1, 478.1, 797, 800; 53/459; 141/147, 166

See application file for complete search history.

(56) References Cited

U.S. PATENT DOCUMENTS 4,676,286 A * 6/1987 Aiuola ..... B01F 13/1058 141/145
5,280,815 A * 1/1994 Jones ..... B65B 3/323 141/147

(Continued)

FOREIGN PATENT DOCUMENTS

| | | |
|---|---|---|
| JP | 2002-326604 A | 11/2002 |
| JP | 2009-023697 A | 2/2009 |
| JP | 2012-166831 A | 9/2012 |

OTHER PUBLICATIONS

Information Offer Form dated Mar. 16, 2020, to Japanese Patent Application No. 2017-162568 with English translation.

*Primary Examiner* — Joseph A Dillon, Jr.

(74) *Attorney, Agent, or Firm* — Pillsbury Winthrop Shaw Pittman, LLP

(57) ABSTRACT

A conveyance mechanism is provided. A bag body processing unit is installed with a roller unit. While the process transfer unit transfers a bag body processing unit from a first guide station to a second guide station, the roller unit moves from a first guide surface to a second guide surface and is placed on the second guide surface in the second guide station. In the second guide station, the roller unit is placed on the second guide surface, and a second guide part is moved from a first variation position to a second variation position while the roller unit is placed on the second guide surface, so that the roller unit is moved from a first height position to a second height position.

21 Claims, 4 Drawing Sheets

(51) Int. Cl.

| | |
|---|---|
| ***B65B 37/04*** | (2006.01) |
| ***B65B 37/02*** | (2006.01) |
| ***B65B 43/30*** | (2006.01) |
| ***B65B 43/54*** | (2006.01) |
| ***B65B 43/46*** | (2006.01) |
| ***B65B 7/06*** | (2006.01) |
| ***B65B 37/16*** | (2006.01) |
| ***B65B 39/00*** | (2006.01) |
| *B65B 51/14* | (2006.01) |
| *B65B 61/02* | (2006.01) |

(56) References Cited

U.S. PATENT DOCUMENTS 6,168,009 B1 * 1/2001 Asai ..... H05K 13/0452 198/468.4
6,499,280 B1 * 12/2002 Tsutsui ..... B65B 43/52 141/169
6,604,344 B2 * 8/2003 Bussey, Jr. ..... B29C 65/745 141/166
6,604,560 B2 * 8/2003 Ikemoto ..... B65B 39/14 141/146
7,913,834 B2 * 3/2011 Paterlini ..... D05B 23/007 198/377.03
8,479,365 B2 * 7/2013 Tubota ..... B23P 19/02 141/144
8,955,665 B2 * 2/2015 Kramer ..... B65C 3/16 198/377.01
10,023,331 B2 * 7/2018 Yamagata ..... B65B 57/14
2002/0157728 A1 10/2002 Ikemoto et al.
2005/0082142 A1 * 4/2005 Voigtmann ..... B65G 47/843 198/475.1
2009/0188209 A1 * 7/2009 Koga ..... B65B 39/02 53/53
2009/0229227 A1 * 9/2009 Raudat ..... B65B 21/06 53/473
2010/0018160 A1 * 1/2010 Fukeda ..... B29C 66/91411 53/407
2014/0283483 A1 * 9/2014 Yoshikane ..... B65B 31/04 53/403
2015/0284123 A1 * 10/2015 Concetti ..... B65B 59/00 53/459
2016/0304229 A1 * 10/2016 Hellenbrand ..... B65B 35/44
2018/0044046 A1 * 2/2018 Yamamoto ..... B29C 66/92311
2019/0185187 A1 * 6/2019 Gandhi ..... B65B 55/24

* cited by examiner

CONVEYANCE MECHANISM

CROSS-REFERENCE TO RELATED APPLICATIONS

This application is based upon and claims the benefit of priority from Japanese Patent Application No. 2017-162568, filed on Aug. 25, 2017; the entire contents of which are incorporated herein by reference.

TECHNICAL FIELD

The present invention relates to a conveyance mechanism which moves in the vertical direction a bag body processing unit, such as a packaging processing unit, for instance a hopper, while transferring the bag body processing unit in the horizontal direction.

BACKGROUND ART

A packaging machine that conveys a bag body and performs various processes (for example, processes for opening, filling, sealing, etc.) on the bag body in a plurality of stations respectively is known. Such a plurality of stations include stations where predetermined processes are performed while a hopper, a liquid filling nozzle, a gas blowing nozzle, a deairing nozzle, or another packaging processing unit is raised and lowered so as to approach or retreat from the bag body.

For example, Japanese patent application publication No. 2012-166831 discloses an elevating type packaging processing apparatus in an intermittent rotary type bag filling packaging machine. In this apparatus disclosed in Japanese patent application publication No. 2012-166831, by moving a cam roller attached to a hopper along a fixedly installed cylindrical cam, a hopper can be raised and lowered between a raising end position and a lowering end position.

SUMMARY OF INVENTION

Technical Problem

In the above-mentioned apparatus disclosed in Japanese patent application publication No. 2012-166831, it is necessary to move the cam roller along the cylindrical cam over three stations in order to raise and lower the hopper between the raising end position and the lowering end position. By raising and lowering the hopper gradually over a plurality of stations in this way, it is possible to gently raise and lower the hopper while the load on the cam roller is reduced.

On the other hand, there is a desire to reduce the number of stations allocated for raising and lowering the hopper. The total number of stations is determined basically according to the device configuration and is limited. Therefore, it may be required to reduce the number of stations for raising and lowering the hopper in order to secure stations for other processes. In addition, in order to save the installation space of the whole apparatus or to reduce the cost, it may be required to reduce the total number of stations to make the apparatus smaller.

In a case where the hopper is raised and lowered by using the inclination of the fixedly provided cam surface as in the apparatus of Japanese patent application publication No. 2012-166831, it is necessary to move the cam roller on the cam surface. Therefore, it is necessary to allocate a plurality of stations which exist over a reasonable extent for raising and lowering the hopper. In addition, when the hopper is intermittently moved and stopped, the apparatus disclosed in Japanese patent application publication No. 2012-166831 can raise and lower the hopper only during the intermittent movements, and cannot raise and lower the hopper during the intermittent stops. Consequently, the substantial time during which the hopper can be raised and lowered is limited. On the other hand, if it is possible to raise and lower the hopper during such intermittent stops, it is possible to lengthen the time that can be allocated for the raising and lowering of the hopper. Further, the hopper can be raised and lowered at the same time as another process performed during an intermittent stop (for example, a process of opening the mouth of a bag), and thus the subsequent processes can be promptly carried out.

It is also conceivable that, while a bag body is intermittently stopped, a driving force of an air cylinder or the like is used to move the roller and the hopper corresponding to the bag body, together with a lifting holder, in the vertical direction. However, in this case, a pre-processing operation to make the lifting holder hold the roller and the hopper is required before the raising and lowering operation, and a post-processing operation to make the lifting holder release the roller and the hopper is required after the raising and lowering operation. In addition, with this method, the roller and the hopper can be raised and lowered only during an intermittent stop, and the roller and the hopper cannot be raised and lowered during an intermittent movement. Therefore, the substantial time during which the hopper can be raised and lowered is limited. In order to raise and lower the hopper in such a limited time, it is necessary to perform the raising and lowering operation at a high speed, but there is a limit to the speeding up of such raising and lowering operation. On the other hand, if it is possible to raise and lower the roller and the hopper without holding and releasing the roller and the hopper, the time that can be allocated to the raising and lowering of the hopper may be substantially lengthened. In addition, in a case of conveying a plurality of bag bodies sequentially, it is unnecessary to perform a post-processing operation for raising and lowering the roller and the hopper corresponding to the preceding bag body, and it is unnecessary to perform a pre-processing operation before the raising and lowering of the roller and the hopper corresponding to the next bag body. Thus, it is possible to secure a relatively long time for the raising and lowering operation and returning operation of the lifting device, and even when a plurality of bag bodies are sequentially conveyed, the roller and the hopper can be continuously raised and lowered at a high speed.

The present invention has been made in view of the above circumstances, and an object thereof is to provide a conveyance mechanism capable of raising and lowering a bag body processing unit, such as a packaging processing unit, even during an intermittent stop. It is another object of the present invention to provide a conveyance mechanism capable of efficiently carrying out the sequential raising and lowering of a plurality of bag body processing units, and thereby carrying out the conveyance of bag bodies and the transferring of bag body processing units, at a high speed.

Solution to Problem

One aspect of the present invention is directed to a conveyance mechanism comprising: a bag body conveyance unit which conveys a bag body and sequentially disposes the bag body in a plurality of stations; a process transfer unit which transfers a bag body processing unit installed with a roller unit in synchronization with conveyance of the bag body and sequentially disposes the bag body processing unit in the plurality of stations; and a guide unit having a guide surface on which the roller unit is placed and which determines positions of the roller unit and the bag body processing unit in a vertical direction, wherein: the guide unit includes a first guide part and a second guide part, the first guide part having a first guide surface which extends from a first guide station towards a second guide station of the plurality of stations, the second guide part having a second guide surface which is disposed in the second guide station, while the process transfer unit transfers the bag body processing unit from the first guide station towards the second guide station, the roller unit is moved from on the first guide surface to on the second guide surface, the second guide surface extends so as to vary from a first height position to a second height position in the vertical direction, the second guide part is provided movably in a direction including a horizontal direction component in the second guide station, and while the bag body processing unit is disposed in the second guide station, the second guide part is moved from a first variation position to a second variation position in a state in which the roller unit is placed on the second guide surface in such a manner that the roller unit is moved from the first height position to the second height position.

A movement speed of the second guide part may be adjusted by a guide drive control unit. The movement speed of the second guide part may be determined according to at least a movement speed of the roller unit.

The guide drive control unit may include: a servomotor which drives the second guide part; and a motor control unit which controls the servomotor. The motor control unit may control the servomotor so as to cause the second guide part to move at the movement speed.

The conveyance mechanism may further comprises: a conveyance drive unit which drives the bag body conveyance unit; a transfer drive unit which is provided separately from the conveyance drive unit and drives the process transfer unit; and a tuning control unit which controls the conveyance drive unit and the transfer drive unit so as to synchronize conveyance of the bag body and transfer of the bag body processing unit.

In a state in which at least a part of the bag body processing unit is positioned above the bag body, the process transfer unit may intermittently transfer the bag body processing unit and stop the bag body processing unit in each of the plurality of stations.

The bag body conveyance unit may convey the bag body along a circular path. The plurality of stations may be provided along the circular path.

The bag body conveyance unit may convey a plurality of bag bodies, number of the plurality of bag bodies being same as number of the plurality of stations. The process transfer unit may transfer a plurality of bag body processing units and a plurality of roller units, number of the plurality of bag body processing units being same as number of the plurality of stations, number of the plurality of roller units being same as number of the plurality of stations.

The first guide surface may extend from the first guide station towards the second guide station so as to vary in the vertical direction from a third height position to the first height position which is between the third height position and the second height position. While the process transfer unit transfers the bag body processing unit from the first guide station to the second guide station, the roller unit may be placed on the first guide surface and be moved from the third height position towards the first height position, and be placed on a part of the second guide surface which is located at the first height position in the second guide station.

The guide unit may include a third guide part having a third guide surface, a fourth guide part having a fourth guide surface, and a fifth guide part having a fifth guide surface. The third guide surface may have the second height position in the vertical direction from the second guide station towards the third guide station among the plurality of stations. The fourth guide surface may be disposed in the third guide station and extend so as to vary in the vertical direction from the second height position to a fourth height position which is between the third height position and the second height position. The fifth guide surface may extend from a fourth guide station towards the third guide station of the plurality of stations so as to vary from the third height position to the fourth height position in the vertical direction. The fourth guide part may be provided movably in a direction including a horizontal direction component in the third guide station. While the process transfer unit transfers the bag body processing unit from the second guide station towards the third guide station, the roller unit may be moved from on the second guide surface to on the third guide surface. While the bag processing unit is disposed in the third guide station, the fourth guide part may be moved from a third variation position to a fourth variation position in a state in which the roller unit disposed in the second height position is placed on the fourth guide surface, so that the roller unit is moved from the second height position to the fourth height position. While the process transfer unit transfers the bag body processing unit from the third guide station to the fourth guide station, the roller unit may be moved from on the fourth guide surface to on the fifth guide surface so as to move the roller unit from the fourth height position to the third height position.

According to the present invention, it is possible to perform raising and lowering a bag body processing unit, such as a packaging processing unit, even during an intermittent stop. Further, to the present invention, it is possible to efficiently carry out the sequential raising and lowering of a plurality of bag body processing units, and thereby carry out the conveyance of bag bodies and the transferring of bag body processing units, at a high speed.

DESCRIPTION OF EMBODIMENTS

Hereinafter, an embodiment of the present invention will be described with reference to the drawings.

[Processing Station]

Figure 1:
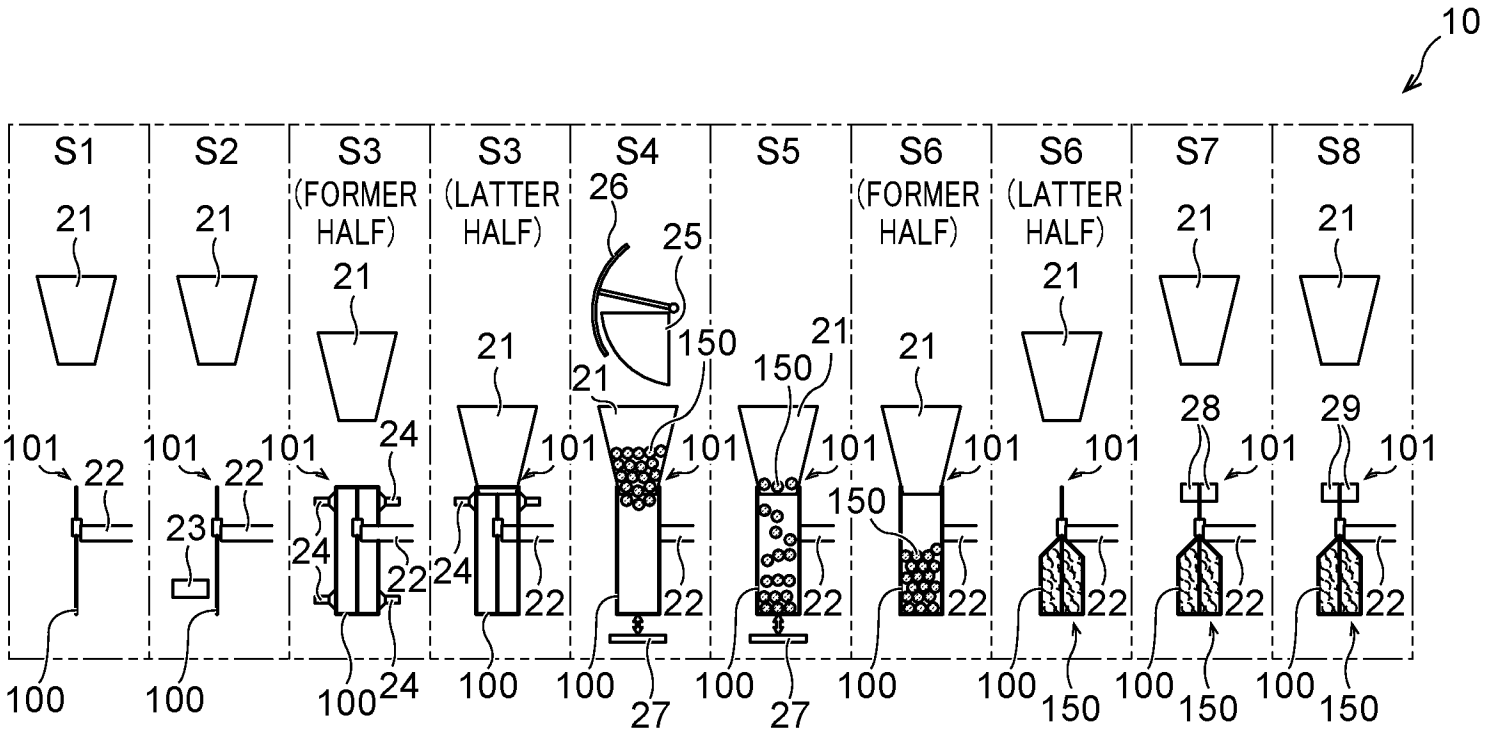
FIG. 1 is a diagram showing a schematic configuration of a packaging machine for explaining the flow of the processes carried out in the respective stations.

FIG. 1 is a diagram showing a schematic configuration of a packaging machine 10, and is a view for explaining a flow of processing in the respective stations. In FIG. 1, the raising/lowering state of a hopper (bag body processing unit) 21 is shown for each station, and in particular, regarding the third station S3 and the sixth station S6, the former half process step and the latter half process step are shown separately. Also, in FIG. 1, regarding the first station S1 to the third station S3 and the sixth station S6 (latter half) to the eighth station S8, the appearance state of the hopper 21 and the like is shown; however, regarding the fourth station S4 to the sixth station S6 (former half), the state of the inside of the hopper 21 and the inside of the bag body 100 is shown while the appearance state of the gripper (holding part) 22 and the like is shown.

In the packaging machine 10, a plurality of stations (eight stations in FIG. 1: the first station S1 to the eighth station S8) are provided. The hopper 21, the gripper 22 and the bag body 100 corresponding to each other intermittently are moved, and are intermittently stopped at the first station S1 to the eighth station S8. The predetermined processes are performed at those stations S1 to S8 respectively. In the present embodiment, a packaging process is carried out by throwing the contents 150 into the bag body 100 via the hopper 21 and then sealing the bag body 100.

In the first station S1, bag bodies 100 are supplied one by one from a magazine (not shown) to a gripper 22 (a bag supplying step). The gripper 22 grips both side parts of the supplied bag body 100 and holds the bag body 100 in a posture in which the mouth part 101 faces upward. In the second station S2, information such as date is printed on the surface of the bag body 100 by a printer 23 (a printing process). In the third station S3, in the former half, the mouth part 101 and the bottom part of the bag body 100 are expanded by opening suction cups 24 (an opening process and a bag bottom expanding process), and in the latter half, the lower part of the hopper 21 is inserted into the bag body 100 through the mouth part 101, so that the discharge port of the hopper 21 is disposed inside the bag body 100 (a hopper inserting step). In the fourth station S4, the discharge port of a content supply container 25 storing contents 150 is opened by a content supply shutter 26, and a predetermined amount of the contents 150 drops from the content supply container 25 towards the inside of the hopper 21. Although the contents 150 illustrated in FIG. 1 are shown as spherical solids, the shape, state and size of the contents 150 are not particularly limited. For example, the state of the contents 150 may be a gas state, a liquid state, a gel state, or two or more states. In addition, if a solid body/solid bodies are thrown into the bag body 100, a single solid body may be put in each bag body 100 as the contents 150, and a plurality of solid bodies may be put in each bag body 100 as the contents 150.

From the fourth station S4 through the sixth station S6 (the former half), the contents 150 fall from the hopper 21 into the bag body 100 (Injection step). In each of the fourth station S4 and the fifth station S5, a tapping member 27 which taps the bottom part of the bag body 100 is provided, and the contents 150 in the bag body 100 are urged to fall. The tapping member 27 provided in the fourth station S4 and the tapping member 27 provided in the fifth station S5 may be constituted by separate members or may be constituted by the same member. In the latter half of the sixth station S6, while the hopper 21 is lifted and retracted from the bag body 100, the gripper 22 pulls both side parts of the bag body 100 outward, thereby closing the mouth part 101 (closing step).

In the seventh station S7, the mouth part 101 of the bag body 100 is simultaneously pressurized and heated by a pair of seal hot plates 28, and in the eighth station S8, the mouth part 101 (in particular, the region which is heated by the seal hot plates 28) is simultaneously pressurized and cooled by a pair of seal cooling plates 29 (sealing step). Then, in the eighth station S8, after the sealing step is performed, the pair of seal cooling plates 29 are separated from the bag body 100, and the gripper 22 releases the bag body 100. As a result, the bag body 100 in which the contents 150 are encapsulated (hereinafter also referred to as "product bag") falls and is received by a receiving unit (not shown), and the product bag is discharged from the packaging machine 10 (discharge step).

In the series of steps described above, the hopper 21 moves up and down as shown in FIG. 1, and is disposed at a predetermined vertical position at each station. Specifically, in the first station S1 to the second station S2, the hopper 21 is disposed at the raising end position. On the other hand, in the course leading from the second station S2 to the third station S3 and in the third station S3, the hopper 21 is lowered and disposed at the lowering end position. Then, over the third station S3 to the sixth station S6, the hopper 21 continues to be disposed at the lowering end position. Then, in the sixth station S6 and in the course leading from the sixth station S6 to the seventh station S7, the hopper 21 is raised and disposed at the raising end position. Then, over the seventh station S7 to the eighth station S8, the hopper 21 continues to be disposed at the raising end position.

On the other hand, while the gripper 22 and the bag body 100 gripped by the gripper 22 go around the first station S1 to the eighth station S8, the gripper 22 and the bag body 100 gripped by the gripper 22 are basically kept disposed at the same vertical position.

Therefore, it is possible that in the first station S1 to the second station S2, the hopper 21 is separated from the bag body 100 with the mouth part 101 closed, and in the third station S3, the hopper 21 is inserted into the open mouth part 101 of the bag body 100. Further, it is possible that in the fourth station S4 to the sixth station S6 (the former half), the contents 150 are appropriately introduced into the bag body 100 via the hopper 21; in the sixth station S6 (the latter half), the hopper 21 is separated from the bag body 100 and the mouth part 101 is closed; and in the seventh station S7 to the eighth station S8, the mouth part 101 is adequately sealed in a state where the hopper 21 is distanced from the bag body 100.

The number and arrangement of the plurality of stations provided in the packaging machine 10 are not particularly limited. Therefore, the first station S1 to the eighth station S8 described above may be sequentially aligned, for example, in a linear manner or in a curved manner, or may be sequentially aligned along a combination of a straight line(s) and a curved line(s). As an example, in FIG. 2 and other drawings described below, the first station S1 to the eighth station S8 are aligned at equal intervals in a circular shape.

[Conveyance Mechanism]

Figure 2:
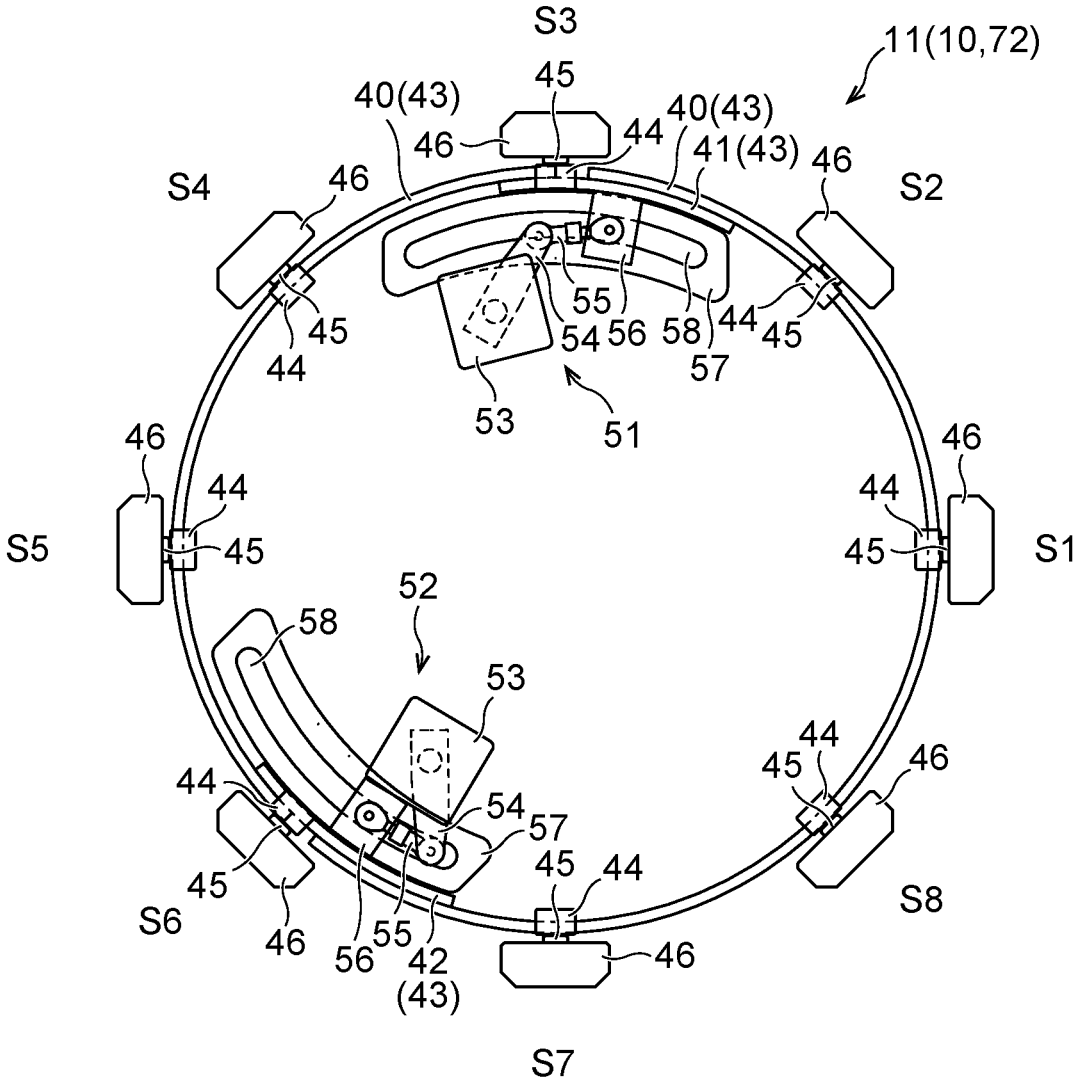
FIG. 2 is a top view showing an example of a conveyance mechanism (in particular, a process transfer device).
Figure 3:
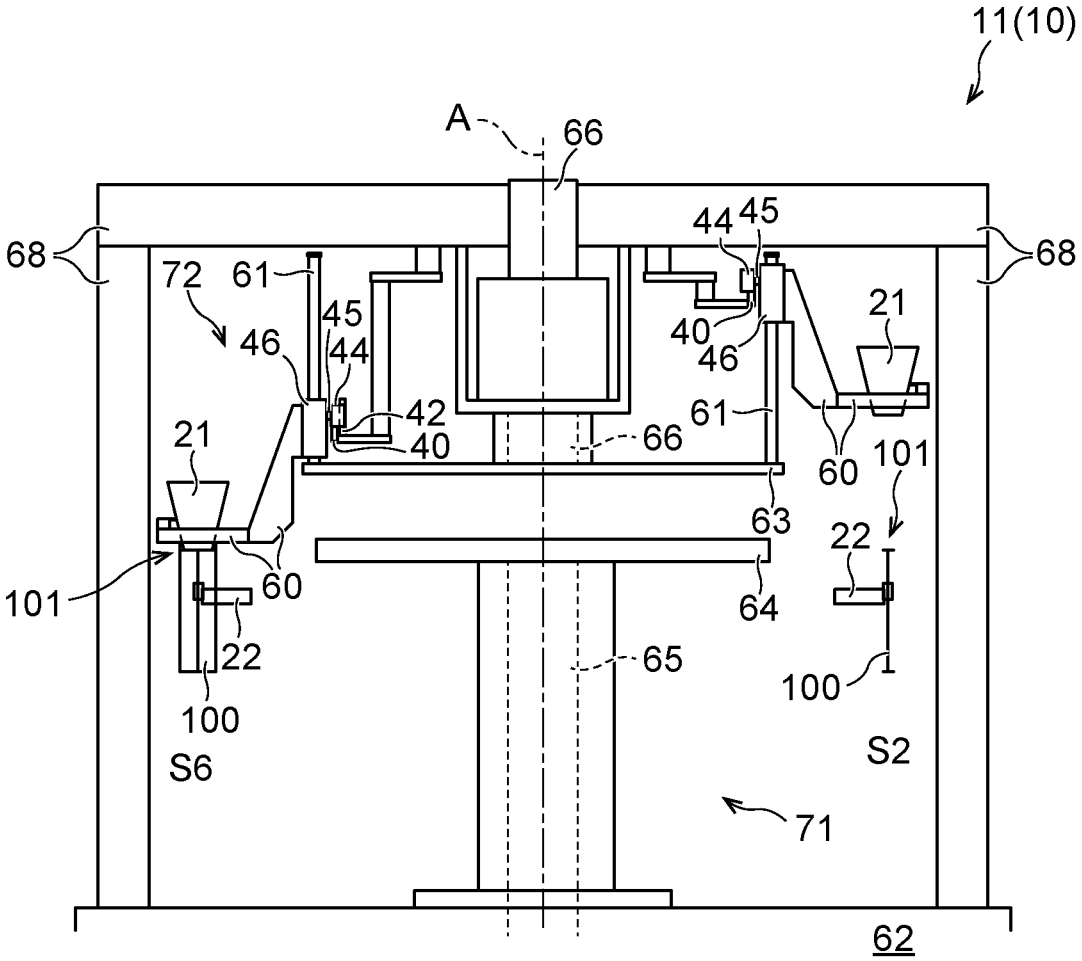
FIG. 3 is a side cross-sectional view of the conveyance mechanism shown in FIG. 2 (that is, a bag body conveyance device and the process transport device).
Figure 4:
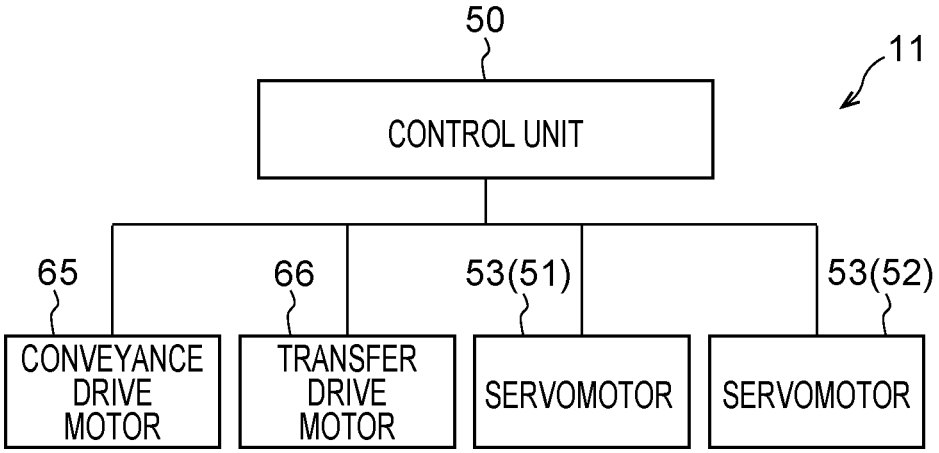
FIG. 4 is a control block diagram of the conveyance mechanism.

FIG. 2 is a top view showing an example of the conveyance mechanism 11 (in particular, the process transfer device 72). FIG. 3 is a side sectional view of the conveyance mechanism 11 (that is, the bag body conveyance device 71 and the process transfer device 72) shown in FIG. 2. FIG. 4 is a control block diagram of the conveyance mechanism 11.

The packaging machine 10 includes a conveyance mechanism 11, and grippers 22 and hoppers 21 described above are moved by the conveyance mechanism 11. Specifically, while the grippers 22, the bag bodies 100 and the hoppers 21 are moved in the horizontal direction by the conveyance mechanism 11, the hoppers 21 are raised and lowered in the vertical direction (see FIG. 1).

The conveyance mechanism 11 includes: a bag body conveyance device (bag body conveyance unit) 71 for conveying bag bodies 100; and a process transfer device (process transfer unit) 72 for transferring the hoppers 21. The bag body conveyance device 71 is driven by a conveyance drive motor (conveyance drive unit) 65. The process transfer device 72 is driven by a transfer drive motor (transfer drive unit) 66, which is provided separately from the conveyance drive motor 65. The conveyance drive motor 65 and the transfer drive motor 66 are controlled by the control unit 50 (see FIG. 4; tuning control unit), and the conveyance of the bag bodies 100 and the transfer of the hoppers 21 are tuned to each other.

The bag body conveyance device 71 conveys the bag bodies 100 with the grippers 22 along a circular path, and the first station S1 to the eighth station S8 are sequentially provided along the circular path. The bag body conveyance device 71 includes the same number of grippers 22 (that is, eight grippers 22) as the number of the stations S1 to S8, and intermittently conveys at a time the bag bodies 100 (that is, eight bag bodies 100), the number of which is the same as the stations S1 to S8. On the other hand, the process transfer device 72 intermittently transfers the hoppers 21 and the roller units 44 (that is, eight hoppers 21 and eight roller units 44) the number of which are the same as the number of stations.

In the following description, the "radial direction" and the "circumferential direction" are directions with reference to the center of the circular path of conveyance of a bag body 100. Further, the "vertical direction" is a direction perpendicular to each of the radial direction and the circumferential direction, and the direction of gravity coincides with the vertically downward direction. The "horizontal direction" is a direction perpendicular to the vertical direction.

[Bag Body Conveyance Device]

The bag body conveyance device 71 includes a bag body conveyance table (first rotating body) 64 and a plurality of grippers 22 attached at equal intervals in the circumferential direction onto the outer peripheral part of the bag body conveyance table 64. The bag body conveyance table 64 is connected to the rotation shaft of the conveyance drive motor 65, and is intermittently rotated about the axis by the conveyance drive motor 65. Each gripper 22 moves on a circular path in accordance with the axial rotation of the bag body conveyance table 64 while holding a bag body 100.

In this way, the bag body conveyance device 71 intermittently conveys a bag body 100 along the circular path, and sequentially arranges the bag body 100 at the first station S1 to the eighth station S8.

[Process Transport Device]

The process transfer device 72 includes: a process section transfer table (second rotating body) 63; and a plurality of guide rails 61 attached to the outer peripheral part of the process section transfer table 63 at equal intervals in the circumferential direction. The process section transfer table 63 is connected to the rotation shaft of the transfer drive motor 66, and is intermittently rotated about the axis by the transfer drive motor 66.

The rotation shaft of the transfer drive motor 66 is disposed coaxially with the rotation shaft of the conveyance drive motor 65, and the central axis of the process section transfer table 63 is disposed coaxially with the central axis of the bag body conveyance table 64. Further, the intermittent rotation of the bag body conveyance table 64 and the intermittent rotation of the process section transfer table 63 are synchronized. Thus, in each station, each hopper 21 is positioned above a bag body 100 gripped by the corresponding gripper 22 in the vertical direction. The bag body conveyance table 64 is provided above a stand 62. Further, the transfer drive motor 66 is attached to an erecting member 68 provided on the stand 62, and the respective servomotors 53 of a cylindrical cam 40, a first guide drive control unit 51 and a second guide drive control unit 52 are also attached to the erecting member 68.

Each guide rail 61 extends upward in the vertical direction from the process section transfer table 63, and a slider 46 is slidably attached to each guide rail 61. A hopper 21 is fixed to each slider 46 via a fixing block 60, and a roller unit 44 is fixed to each slider 46 via a connecting shaft 45. Each roller unit 44 is disposed closer to the central axis of the process section transfer table 63 than the corresponding slider 46 in the radial direction. Each hopper 21 is arranged on the outer side in the radial direction, compared to the process section transfer table 63.

As described above, the hopper 21, the fixing block 60, the slider 46, the guide rail 61, the connecting shaft 45 and the roller unit 44 constitute one set, and a plurality of sets each including these elements are attached to the outer peripheral part of the process section transfer table 63 at equal intervals in the circumferential direction. The number of sets corresponds to the number of stations provided in the conveyance mechanism 11, and in the illustrated process transfer device 72, eight sets including the hopper 21 and the roller unit 44 described above are provided. In this manner, a corresponding unique roller unit 44 is attached via a slider 46 to each hopper 21, and each hopper 21 moves up and down in the vertical direction together with the corresponding roller unit 44.

All or most of the above-described process transfer device 72 is provided above the bag body conveyance device 71 in the vertical direction. In a state in which at least a part of each hopper 21 is positioned above the corresponding bag body 100, the process transfer device 72 intermittently transfers each hopper 21 along the circular path, and halts each hopper 21 at each of the first station S1 to the eighth station S8.

In this way, the process transfer device 72 transfers the plurality of hoppers 21 synchronously with the conveyance of the bag bodies 100 and the grippers 22, and sequentially arranges the plurality of hoppers 21 in the first station S1 to the eighth station S8. Specifically, the gripper 22, the bag body 100 and the hopper 21 corresponding to each other are synchronously moved, and in each of the first station S1 to the eighth station S8, the transfer of the hopper 21 performed by the process transfer device 72 and the conveyance of the bag body 100 performed by the bag body conveyance device 71 are synchronized with each other in such a manner that each hopper 21 is positioned above the bag body 100 gripped by the corresponding gripper 22. In particular, by synchronizing the shaft rotations of the process section transfer table 63 and the bag body conveyance table 64 with each other, the transfer of each hopper 21 in the horizontal direction is synchronized with the conveyance of the bag body 100 gripped by the corresponding gripper 22. On the other hand, the raising and lowering of each hopper 21 in the vertical direction is carried out by moving the corresponding roller unit 44 up and down while the corresponding roller unit 44 is rolling on the guide surface 43 of the guide units 40, 41, 42.

[Guide Units]

The conveyance mechanism 11 further includes the guide units 40, 41, and 42. The guide units 40, 41, 42 have guide surfaces 43 on which the roller units 44 are placed, and the guide surfaces 43 determine the vertical positions of the roller units 44 and the hoppers 21.

The illustrated guide units include: a cylindrical cam 40 (a first guide part, a third guide part, and a fifth guide part) fixedly provided with respect to the stations S1 to S8; and a first auxiliary cam 41 (a second guide part) and a second auxiliary cam (a fourth guide part) 42 which are provided in the third station S3 and the sixth station S6 to be capable of moving in the horizontal direction. The guide surfaces 43 are formed by the upper end surfaces of these cams 40, 41, 42. The guide surfaces 43 are provided on the moving path of the roller units 44, and in the present embodiment, are positioned on the circular path of the roller unit 44 based on the shaft rotation of the process section transfer table 63.

Each roller unit 44 moves while rolling on the guide surfaces 43 of the guide units 40, 41, 42. The guide surfaces 43 are arranged at vertical positions which are determined for the respective stations. Accordingly, each of the roller units 44 moving on the guide surfaces 43 is disposed at a vertical position corresponding to the part of the guide surfaces 43 with which each roller unit 44 is in contact, and each hopper 21 is disposed at a vertical position determined depending on the vertical position of the corresponding roller unit 44. Specifically, as each roller unit 44 moves up and down according to the contact position of the guide surfaces 43, each hopper 21 moves up and down together with the corresponding connecting shaft 45, the slider 46 and the fixing block 60.

[Cylindrical Cam]

The vertically upper end face of the cylindrical cam 40 forms a roughly ring-shaped guide surface 43. All parts of the guide surface 43 formed by this cylindrical cam 40 are positioned at equal distances from the central axis of the process section transfer table 63 in the radial direction. The central axis of the guide surface 43 of the cylindrical cam 40 coincides with the central axis of the conveyance path for bag bodies 100, the central axis of the process section transfer table 63, the central axis of the bag body conveyance table 64, the rotation axis of the conveyance drive motor 65, and the rotation axis of the transfer drive motor 66, and coincides with the axis denoted by the reference of "A" show in FIG. 3.

Note that the guide surface 43 of the cylindrical cam 40 of the present embodiment is discontinued at a part of each of the sections where the first auxiliary cam 41 and the second auxiliary cam 42 are provided. Specifically, in the illustrated conveyance mechanism 11, there are parts where the guide surface 43 of the cylindrical cam 40 does not exist in the third station S3 and the sixth station S6 respectively.

[Auxiliary Cams]

The vertically upper end surface of each of the first auxiliary cam 41 and the second auxiliary cam 42 forms an arc-like guide surface 43 in a range including a section corresponding to a part where the cylindrical cam 40 is interrupted. The illustrated first and second auxiliary cams 41 and 42 are provided at the third station and the sixth station respectively, and are disposed on the inner side of the cylindrical cam 40 (specifically, on the central axis side of the process section transfer table 63, compared to the cylindrical cam 40). The curvatures of the outer peripheral surfaces of the first auxiliary cam 41 and the second auxiliary cam 42 approximately coincide with the curvature of the inner peripheral surface of the cylindrical cam 40, and the first auxiliary cam 41 and the second auxiliary cam 42 are provided so as to be movable in the circumferential direction along the inner peripheral surface of the cylindrical cam 40. Therefore, the guide surface 43 formed by the whole of the guide units 40, 41, 42 has a substantially ring-like shape when viewed from above.

The movement speed of the above-mentioned first auxiliary cam 41 and second auxiliary cam 42 is adjusted by the first guide drive control unit 51 and the second guide drive control unit 52 respectively, so that the positions of the first auxiliary cam 41 and the second auxiliary cam 42 in the circumferential direction are adjusted. The movement speed and the movement timing of the first auxiliary cam 41 and the second auxiliary cam 42 are determined in advance on the basis of at least the movement speed and the movement timing of the roller units 44.

[Guide Drive Control Units]

The first guide drive control unit 51 and the second guide drive control unit 52 have the same mechanism as each other. Hereinafter, a configuration example of the first guide drive control unit 51 will be mainly described, but the second guide drive control unit 52 can also be configured similarly to the first guide drive control unit 51.

The first guide drive control unit 51 includes: a servomotor (first auxiliary cam drive unit) 53 which drives the first auxiliary cam 41; and a control unit 50 which controls the servomotor 53 (see FIG. 4: motor control unit). The control unit 50 can control the servomotor 53 to move the first auxiliary cam 41 at a predetermined speed and accurately arrange the first auxiliary cam 41 at a desired position.

The first guide drive control unit 51 shown in FIG. 2 includes: a connecting lever 54 fixedly attached to the rotation shaft of the servomotor 53; a connecting rod 55 which is rotatably attached to the connecting lever 54; an auxiliary cam moving member 56 which is rotatably attached to the connecting rod 55 and to which the first auxiliary cam 41 is fixedly attached; and a movement regulation member 57 which has a guide groove 58 formed thereon and regulates the auxiliary cam moving member 56 to permit only the movement of the auxiliary cam moving member 56 along the guide groove 58.

By rotating the rotation shaft of the servomotor 53 under the control of the control unit 50, the connecting lever 54 and the connecting rod 55 are swung to move the auxiliary cam moving member 56 along the guide groove 58 in such a manner that the first auxiliary cam 41 can be moved in the circumferential direction. The connecting lever 54 and the connecting rod 55 assume a swing posture according to the rotation angle of the rotation shaft of the servomotor 53, and the first auxiliary cam 41 is disposed at a circumferential direction position determined according to the swing posture of the connecting lever 54 and the connecting rod 55. Therefore, by controlling the rotation angle of the rotation shaft of the servomotor 53 of the first guide drive control unit 51, the position of the first auxiliary cam 41 can be accurately adjusted. The rotation angle, rotation speed, and rotation timing of the rotation shaft of the servomotor 53 are adjusted under the control of the control unit 50.

Similarly to the above-described first guide drive control unit 51, the second guide drive control unit 52 also has a servomotor 53, a connecting lever 54, a connecting rod 55, an auxiliary cam moving member 56, a movement regulation member 57, and a guide groove 58. By causing the control unit 50 to adjust the rotation angle, rotation speed and rotation timing of the rotation shaft of the servomotor 53 of the second guide drive control unit 52, the second auxiliary cam 42 attached to the auxiliary cam moving member 56 can be moved at a predetermined speed and the second auxiliary cam 42 can be accurately disposed at a desired position.

The first guide drive control unit 51 having the above-described configuration moves the first auxiliary cam 41 in the circumferential direction at a predetermined speed. Similarly, the second guide drive control unit 52 moves the second auxiliary cam 42 in the circumferential direction at a predetermined speed. Specifically, the control unit 50 controls each of the servomotors 53 on the basis of the information indicating the positions of the roller units 44, and adjusts the arrangement positions of the first auxiliary cam 41 and the second auxiliary cam 42. Specifically, the control unit 50 monitors the drive states (e.g., the rotation angles) of the conveyance drive motor 65 and the transfer drive motor 66, and acquires the information indicating the positions of the roller units 44 on the basis of those drive states. As described above, the illustrated control unit 50 controls the respective servomotors 53 of the first guide drive control unit 51 and the second guide drive control unit 52 according to the drive states of the conveyance drive motor 65 and the transfer drive motor 66.

It is to be noted that each of the roller units 44 has a size large enough to extend over both the guide surface 43 of the cylindrical cam 40 and the guide surface 43 of an auxiliary cam (that is, one of the first auxiliary cam 41 and the second auxiliary cam 42) in the radial direction. Specifically, in the area where both the cylindrical cam 40 and the first auxiliary cam 41 overlap each other (hereinafter also referred to as "overlapping area"; in the third station S3 in the illustrated conveyance mechanism 11), each roller unit 44 is positioned above both the guide surface 43 of the cam 40 and the guide surface 43 of the first auxiliary cam 41. Similarly, in the overlapping area where both the cylindrical cam 40 and the second auxiliary cam 42 overlap each other (in the sixth station S6 in the illustrated conveyance mechanism 11), each roller unit 44 is positioned above both the guide surface 43 of the cylindrical cam 40 and the guide surface 43 of the second auxiliary cam 42. Therefore, the guide surface 43 of the cylindrical cam 40 and/or the guide surfaces 43 of the auxiliary cam 41, 42 are present along the circular path of each roller unit 44; the guide surfaces 43 are provided in a ring shape as a whole; and each roller unit 44 always comes into contact with at least one of these guide surfaces 43 and is disposed at a vertical position corresponding to the vertical position of the guide surface 43 with which each roller unit 44 comes into contact.

[Raising and Lowering Mechanism]

Next, the raising and lowering mechanism of the hoppers 21 will be described. In the following description, the raising and lowering mechanism of the roller units 44 will mainly be described. As described above, since a hopper 21 moves up and down together with a roller unit 44 in the vertical direction, the raising and lowering mechanism of a hopper 21 becomes clear by clarifying the raising and lowering mechanism of a roller unit 44 as described below.

Figure 5:
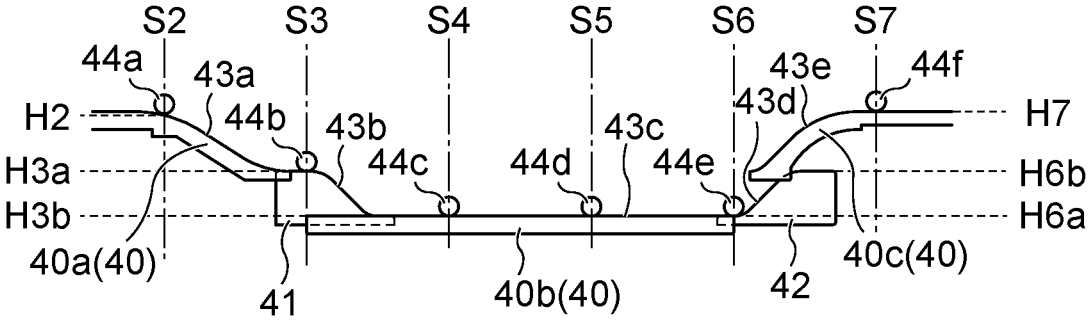
FIG. 5 is a view for explaining a raising lowering guide mechanism of roller units, and mainly shows the raising and lowering of the roller units over the second to seventh stations.
Figure 6:
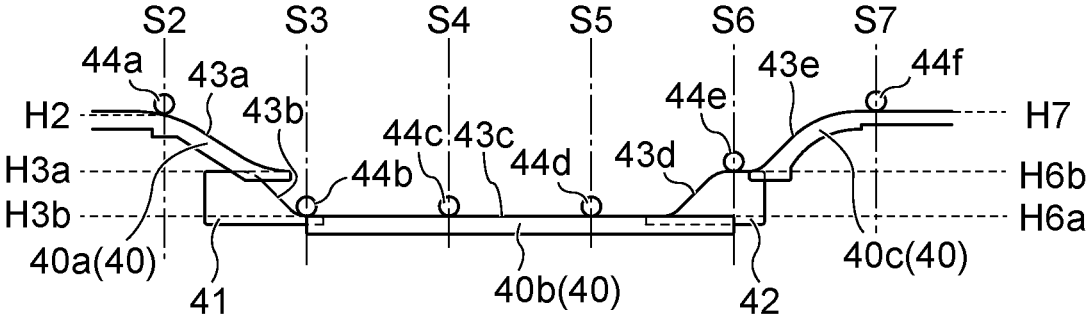
FIG. 6 is a view for explaining the raising lowering guide mechanism of the roller units, and mainly shows the raising and lowering of the roller units over the second to seventh stations.
Figure 7:
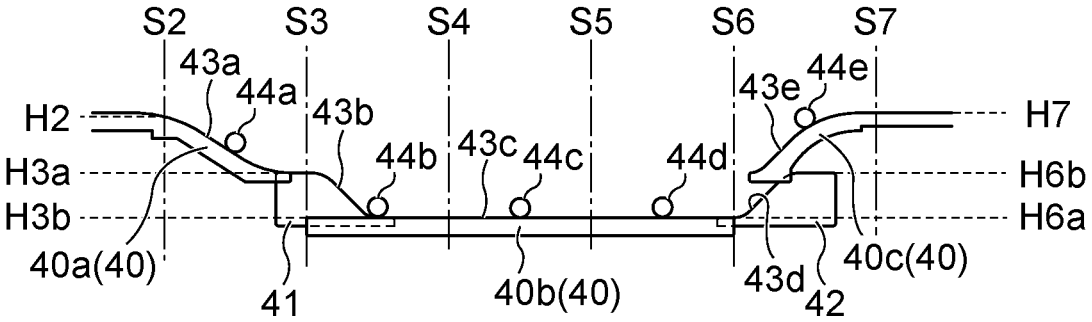
FIG. 7 is a view for explaining the raising lowering guide mechanism of the roller units, and mainly shows the raising and lowering of the roller units over the second to seventh stations.

FIGS. 5 to 7 are diagrams for explaining the raising lowering guide mechanism of the roller units 44, and mainly show the raising and lowering of the roller units 44 in the second station S2 to the seventh station S7. FIG. 5 shows a state immediately after intermittently stopping each roller unit 44 at each station, FIG. 6 shows a state immediately before moving from a state in which each roller unit 44 is intermittently stopped, and FIG. 7 shows a state in which the roller units 44 are intermittently moving.

Although the first station S1 to the eighth station S8 of the present embodiment are aligned on a circular path (see FIG. 2) in reality, each of FIGS. 5 to 7 conceptually illustrates that the second station S2 to the seventh station S7 are aligned in a linear arrangement in order to facilitate understanding. Also, the one-dot chain lines shown in FIGS. 5 to 7 indicate the positions where the roller units 44 are intermittently stopped at the respective stations. Further, reference numerals "44*a*" to "44*e*" denote the roller units 44 respectively, reference numerals "43*a*" to "43*e*" denote the guide surfaces 43 respectively, and reference numerals "40*a*" to "40*c*" denote the cylindrical cams 40 respectively. Moreover, the vertical position of each roller unit 44 is represented by the position in the vertical direction of the part of the guide surface 43 with which each roller unit 44 is in contact.

The cylindrical cam 40, the first auxiliary cam 41 and the second auxiliary cam 42 are arranged in the second station S2 to the seventh station S7 as shown in each of FIGS. 5 to 7. A first guide surface 43*a* is formed by a part of the cylindrical cam 40 extending from the second station S2 towards the third station S3 (that is, by a first cylindrical cam part (first guide part) 40*a*). Further, a second guide surface 43*b* is formed by the first auxiliary cam (second guide part) 41. Moreover, a third guide surface 43*c* is formed by a part of the cylindrical cam 40 extending from the third station S3 to the sixth station S6 (that is, by a second cylindrical cam part (third guide part) 40*b*). Furthermore, a fourth guide surface 43*d* is formed by the second auxiliary cam (fourth guide part) 42. In addition, a fifth guide surface 43*e* is formed by a part of the cylindrical cam 40 extending from the seventh station S7 towards the sixth station S6 (that is, by a third cylindrical cam part (fifth guide part) 40*c*).

In the illustrated cylindrical cam 40, the first cylindrical cam part 40*a* and the third cylindrical cam part 40*c* are formed by the same member, and the second cylindrical cam part 40*b* is separated from each of the first cylindrical cam part 40*a* and the third cylindrical cam part 40*c*. In this regard, however, the second cylindrical cam part 40*b* may be provided integrally with the first cylindrical cam part 40*a* and/or the third cylindrical cam part 40*c*, and the first cylindrical cam part 40*a* and the third cylindrical cam part 40*c* may be separated from each other.

When the first auxiliary cam 41 is moved in the circumferential direction with respect to the third station S3, the first auxiliary cam 41 is moved between a first variation position (see FIGS. 5 and 7) and a second variation position (see FIG. 6). The first variation position is a position where a roller unit 44 which is intermittently stopped at the third station S3 is placed on a part of the second guide surface 43*b* the position of which is at the third station upper height position H3*a* (i.e., a first height position) (see reference numeral "44*b*" shown in FIG. 5). On the other hand, the second variation position is a position where a roller unit 44 which is intermittently stopped at the third station S3 is placed on a part of the second guide surface 43*b* the position of which is at the third station lower height position H3*b* (i.e., a second height position) (see reference numeral "44*b*" shown in FIG. 6).

When the second auxiliary cam 42 is moved in the circumferential direction with respect to the sixth station S6, the second auxiliary cam 42 is moved between a third variation position (see FIGS. 5 and 7) and a fourth variation position (see FIG. 6). The third variation position is a position where a roller unit 44 which is intermittently stopped at the sixth station S6 is placed on a part of the fourth guide surface 43*d* the position of which is at the sixth station lower height position H6*a* (see reference numeral "44*e*" shown in FIG. 5). On the other hand, the fourth variation position is a position where a roller unit 44 which is intermittently stopped at the sixth station S6 is placed on a part of the fourth guide surface 43*d* the position of which is at the sixth station upper height position H6*b* (i.e., a fourth height position) (see reference numeral "44*e*" shown in FIG. 6).

The first guide surface 43*a* extends from the second station (first guide station) S2 towards the third station (second guide station) S3 of the plurality of stations S1 to S8 so as to smoothly vary in the vertical direction from the second station height position H2 (the third height position) to the third station upper height position H3*a*. The third station upper height position H3*a* is a position between the second station height position H2 and the third station lower height position H3*b* with respect to the vertical direction, and is a central position between the second station height position H2 and the third station lower height position H3*b*, for example. Note that the first guide surface 43*a* extends up to the position where a roller unit 44 which is intermittently stopped at the third station S3 cannot be placed.

The second guide surface 43*b* is disposed in the third station S3, is provided movably in the horizontal direction in the third station S3, and extends so as to smoothly vary from the third station upper height position H3*a* to the third station lower height position H3*b* in the vertical direction.

The third guide surface 43*c* horizontally extends from the third station S3 towards the sixth station (third guide station) S6 of the plurality of stations S1 to S8, and has the same height (that is, has the same height position as the third station lower height position H3*b* (i.e., the second height position)). Therefore, the sixth station lower height position H6*a* is the same vertical position as the third station lower height position H3*b* (i.e., the second height position).

The fourth guide surface 43*d* is disposed in the sixth station S6, is provided movably in the horizontal direction in the sixth station S6, and extends so as to smoothly vary from the sixth station lower height position H6*a* to the sixth station upper height position H6*b* in the vertical direction. The sixth station upper height position H6*b* is a position between the seventh station height position H7 and the sixth station lower height position H6*a* in the vertical direction, and may be the same vertical position as the third station upper height position H3*a* or may be a different vertical position from the third station upper height position H3*a*. Also, the seventh station height position H7 may be the same vertical position as the second station height position H2, or may be a different vertical position from the second station height position H2. In FIGS. 5 to 7, the seventh station height position H7 is set to the same vertical position as the second station height position H2 (third height position).

The fifth guide surface 43*e* extends from the seventh station (a fourth guide station) S7 towards the sixth station S6 of the plurality of stations S1 to S8 so as to smoothly vary from the seventh station height position H7 to the sixth station upper height position H6*b*. The fifth guide surface 43*e* extends so as not to overlap in the vertical direction with a roller unit 44 which is stopped at the sixth station S6.

While the process transfer device 72 transfers a hopper 21 from the second station S2 towards the third station S3, the roller unit 44 corresponding to the hopper 21 is placed on the first guide surface 43*a*, is moved along the first guide surface 43*a* from the second station height position H2 towards the third station upper height position H3*a*, subsequently is moved from on the first guide surface 43*a* to on the second guide surface 43*b*, and in the third station S3, is placed on a part of the second guide surface 43*b* located at the third station upper height position H3*a*. Specifically, when each roller unit 44 moves from the second station S2 towards the third station S3, each roller unit 44 moves along the first guide surface 43*a* of the first cylindrical cam part 40*a*, and gradually descends from the second station height position H2 towards the third station upper height position H3*a* according to the inclination of the first guide surface 43*a* (see reference numeral "44*a*" shown in FIG. 7). Each roller unit 44 is moved onto the second guide surface 43*b* and leaves the first guide surface 43*a* before being stopped at the third station S3, and when each roller unit 44 is stopped at the third station S3, the roller unit 44 is supported only by the guide surface 43*b* at the third station S3.

Before a roller unit 44 which moves from the second station S2 towards the third station S3 reaches the third station S3 (more specifically, before this roller unit 44 leaves the first guide surface 43*a*), the first guide drive control unit 51 (see FIGS. 2 and 4) adjusts the arrangement position of the first auxiliary cam 41 in such a manner that the second guide surface 43*b* is disposed at the first variation position (see FIG. 7). As a result, when the process transfer device 72 transfers a hopper 21 from the second station S2 to the third station S3, the first auxiliary cam 41 is disposed at the first variation position and the roller unit 44 corresponding to the hopper 21 is able to smoothly move from above the first guide surface 43*a* to on the second guide surface 43*b*. In this manner, a roller unit 44 is placed on the second guide surface 43*b* arranged at the first variation position in the third station S3, and is positioned at the third station upper height position H3*a* in the vertical direction.

In at least a part of the time period when a hopper 21 is being transferred by the process transfer device 72 from the second station S2 to the third station S3, the roller unit 44 corresponding to the hopper 21 is placed on both the first guide surface 43*a* and the second guide surface 43*b*. Specifically, when a roller unit 44 passes over the overlapping area where the cylindrical cam 40 and the first auxiliary cam 41 are provided so as to overlap each other, the roller unit 44 is arranged above both the first guide surface 43*a* and the second guide surface 43*b*. Regarding the most upstream side position of the overlapping area (specifically, the position which is the closest to the second station S2), at least while the roller unit 44 passes this most upstream side position, the first guide surface 43*a* is arranged at the same position as the second guide surface 43*b* or at a position above the second guide surface 43*b*. Further, regarding the most downstream side position of the overlapping area (specifically, the position which is the closest to the third station S3), at least while the roller unit 44 passes this most downstream side position, the second guide surface 43*b* is arranged at the same position as the first guide surface 43*a* or at a position above the first guide surface 43*a*. As a result, in the overlapping area, the roller unit 44 can be smoothly transferred from on the first guide surface 43*a* to on the second guide surface 43*b*. In the overlapping area, the first guide surface 43*a* and the second guide surface 43*b* may extend in the horizontal direction in whole or in part, or may be inclined in whole or in part with respect to the vertical direction.

In this way, at the initial stage when each roller unit 44 moves from the second station S2 towards the third station S3, each roller unit 44 contacts the first guide surface 43*a* of the first cylindrical cam part 40*a* and is arranged at the same vertical position as the first guide surface 43*a*. Then, each roller unit 44 is disposed above the first guide surface 43*a* and the second guide surface 43*b* in a certain range before reaching the position where the roller unit 44 is intermittently stopped at the third station S3, and comes into contact with the higher one of the first guide surface 43*a* and the second guide surface 43*b*, so that the position of the roller unit 44 is determined in terms of the vertical direction. Then, each roller unit 44 is disposed at the same vertical position as the second guide surface 43*b* at a position where the roller unit 44 is intermittently stopped at the third station S3.

After a roller unit 44 intermittently stops at the third station S3, the first auxiliary cam 41 is moved in the circumferential direction (specifically, in the circumferential direction opposite to the traveling direction of the roller unit 44 (i.e., the direction from the third station S3 towards the second station S2)) (see FIG. 6). As a result, the first auxiliary cam 41 is moved from the first variation position to the second variation position in a state in which the roller unit 44 is placed on the second guide surface 43*b*. Specifically, while the roller unit 44 and the hopper 21 which correspond to each other are disposed in the third station S3 (specifically, while the roller unit 44 and the hopper 21 stop at the third station S3), the first auxiliary cam 41 is moved from the first variation position to the second variation position. During this movement, under the influence of gravity, the roller unit 44 is axially rotated (i.e., is rolling) on the second guide surface 43*b* in a state in which the roller unit 44 stops at the third station S3, and is moved from the third station upper height position H3*a* to the third station lower position H3*b* along the second guide surface 43*b*, so that the hopper 21 descends together with the corresponding roller unit 44 (see reference numeral "44*b*" shown in FIGS. 5 and 6). Therefore, under the control of the control unit 50, the servomotor 53 of the first guide drive control unit 51 moves the first auxiliary cam 41 from the first variation position to the second variation position after the roller unit 44 is positioned outside the first guide surface 43*a*.

When each roller unit 44 is arranged at the same vertical position (the second height position H2) as the third station lower height position H3*b*, the lower end part of the corresponding hopper 21 is positioned inside the corresponding bag body 100 through the mouth part 101 of the bag body 100.

Then, while the process transfer device 72 transfers the hopper 21 from the third station S3 towards the sixth station S6, the roller unit 44 corresponding to the hopper 21 is transferred from on the second guide surface 43*b* to on the third guide surface 43*c*, and then is moved along the third guide surface 43*c*.

Based on the timing at which the roller unit 44 moves from the third station S3 towards the fourth station S4 with the intermittent rotation of the process section transfer table 63, the first auxiliary cam 41 is moved in the circumferential direction (specifically, in the circumferential direction which is the same direction as the traveling direction of the roller unit 44) (that is, in the direction from the third station S3 towards the fourth station S4) in such a manner that the first auxiliary cam 41 is returned from the second variation position to the first variation position (see FIG. 7). In this process, the movement timing and movement speed of the first auxiliary cam 41 are adjusted in such a manner that the roller unit 44 moving from the third station S3 towards the fourth station S4 is not raised by the second guide surface 43*b*. For example, the start timing of the movement of the first auxiliary cam 41 from the second variation position to the first variation position may be made the same as or may be later than the start timing of the movement of the roller unit 44 from the third station S3 to the fourth station S4, and the movement speed of the first auxiliary cam 41 from the second variation position to the first variation position may be made the same as or may be slower than the movement speed of the roller unit 44 from the third station S3 to the fourth station S4.

In the sixth station S6, a roller unit 44 is raised in accordance with the reverse flow from the downward movement mechanism of the roller unit 44 in the above-described third station S3. Specifically, in the sixth station S6, the roller unit 44 arranged at the sixth station lower height position H6*a* is placed on the fourth guide surface 43*d*. Then, while the roller unit 44 is intermittently stopped at the sixth station S6, the second auxiliary cam 42 is moved from the third variation position (see FIG. 5) to the fourth variation position (see FIG. 6) in a state in which the roller unit 44 is placed on the fourth guide surface 43*d*, so that the roller unit 44 is moved from the sixth station lower height position H6*a* to the sixth station upper height position H6*b*. Therefore, before the roller unit 44 moving from the fifth station S5 towards the sixth station S6 reaches the sixth station S6, the second guide drive control unit 52 (see FIGS. 2 and 4) adjusts the position of the second auxiliary cam 42 so as to arrange the fourth guide surface 43*d* at the third variation position (see FIG. 7).

Then, while the process transfer device 72 transfers a hopper 21 from the sixth station S6 towards the seventh station S7, the roller unit 44 disposed on the fourth guide surface 43*d* at the sixth station upper height position H6*b* is placed on the fifth guide surface 43*e*, and the roller unit 44 is moved from the sixth station upper height position H6*b* to the seventh station height position H7 along the fifth guide surface 43*e*. Based on the timing at which the roller unit 44 is moved from the sixth station S6 to the seventh station S7 with the intermittent rotation of the process section transfer table 63, the second auxiliary cam 42 is moved in the circumferential direction (specifically, in the circumferential direction which is the same direction as the traveling direction of the roller unit 44) (that is, in the direction from the sixth station S6 towards the seventh station S7) in such a manner that the second auxiliary cam 42 is returned from the fourth variation position to the third variation position (see FIG. 7). In this case, the movement timing and the movement speed of the second auxiliary cam 42 are adjusted in such a manner that the roller unit 44 moving from the sixth station S6 towards the seventh station S7 is not lowered by the fourth guide surface 43*d*. For example, the start timing of the movement of the second auxiliary cam 42 from the fourth variation position to the third variation position may be the same as or may be later than the start timing of the movement of the roller unit 44 from the sixth station S6 to the seventh station S7, and the movement speed of the second auxiliary cam 42 from the fourth variation position to the third variation position may be the same as or may be slower than the movement speed of the roller unit 44 from the sixth station S6 to the seventh station S7.

The timing of moving the first auxiliary cam 41 from the first variation position (see FIG. 5) towards the second variation position (see FIG. 6) may be the same as or may be different from the timing of moving the second auxiliary cam 42 from the third variation position (see FIG. 5) towards the fourth variation position (see FIG. 6). Further, the timing of moving the first auxiliary cam 41 from the second variation position to the first variation position may be the same as or may be different from the timing of moving the second auxiliary cam 42 from the fourth variation position to the third variation position.

As described above, by combining the cylindrical cam 40 and the auxiliary cams (specifically, the first auxiliary cam 41 and the second auxiliary cam 42) described above, a hopper 21 can be raised and lowered over a vertical distance equal to or longer than the conventional distance while the number of stations which are allocated for the raising and lowering of a hopper 21 can be reduced. In particular, by utilizing the movement of the auxiliary cams having the inclined guide surfaces 43 (specifically, the first auxiliary cam 41 and the second auxiliary cam 42), a roller unit 44 and a hopper 21 can be raised and lowered even during an intermittent stop. As a result, for example, in the third station S3, the opening tip end part of a hopper 21 can be inserted into a bag body 100 immediately after the mouth part 101 of the bag body 100 is opened, and consequently a long period of time can be secured for a subsequent process. Specifically, it is possible to promptly carry out the input process of the contents 150 at the fourth station S4, and sufficient time can be secured for dropping and receiving of the contents 150 into a bag body 100 over the fourth station S4 to the sixth station S6. Similarly, in the sixth station S6, the mouth part 101 of a bag body 100 can be closed by driving a gripper 22 immediately after a hopper 21 is retracted from the mouth part 101 of the bag body 100. As a result, the sealing process performed in the seventh station S7 and the eighth station S8 can be promptly performed, and the time for the sealing process of the mouth part 101 can be sufficiently secured.

Further, by combining the raising and lowering of the roller units 44 and the hoppers 21 during the intermittent movement and the raising and lowering of the roller units 44 and the hoppers 21 during the intermittent stop, the inclination of raising and lowering of the hoppers 21 can be suppressed, and the load applied to the roller units 44 can be effectively reduced. In the above embodiment, among the plurality of stations S1 to S8, the stations allocated for the lowering operation of a hopper 21 are only the second station S2 and the third station S3 which are provided adjacent to each other, and virtually, it is possible to lower the hopper 21, by the distance comparable to the conventional apparatus, only in the section which corresponds to one step. As described above, according to the conveyance mechanism 11 of the present embodiment, a hopper 21 can be raised and lowered efficiently with a relatively gentle inclination angle in a limited step.

Further, by moving the first auxiliary cam 41 and the second auxiliary cam 42 using the servomotors 53, the first auxiliary cam 41 and the second auxiliary cam 42 can be moved at a desired speed while the positions of the first auxiliary cam 41 and the second auxiliary cam 42 can be controlled. In this way, the first auxiliary cam 41 and the second auxiliary cam 42 can be accurately moved and arranged according to the movement and arrangement of the roller units 44, and the raising and lowering of the roller units 44 can be carried out in a smooth manner by means of the first auxiliary cam 41 and the second auxiliary cam 42.

Further, by utilizing the cylindrical cam 40 and the auxiliary cams (i.e., the first auxiliary cam 41 and the second auxiliary cam 42) for raising and lowering the roller units 44 and the hoppers 21, actions of holding and releasing the roller units 44 and the hoppers 21 for the raising and lowering are not required. Therefore, it is possible to promptly perform the start operation of the transfer of the roller units 44 and the hoppers 21 for raising and lowering and the operation of returning the auxiliary cams to the original positions, so that the time for raising and lowering the roller units 44 and the hoppers 21 and the time for returning the auxiliary cams to the original positions can be sufficiently secured. Therefore, according to the conveyance mechanism 11 of the present embodiment, it is possible to efficiently perform sequential upward and downward movements of a plurality of hoppers 21, and to perform the conveyance of bag bodies 100 and the transfer of the hoppers 21 at a high speed.

[Modifications]

The present invention is not limited to the above-described embodiments and modifications. For example, various modifications may be made to each element of the embodiments and the modifications described above.

For example, in the above-described embodiments, the conveyance drive motor 65 and the transfer drive motor 66 provided separately are used as the drive source of the bag body conveyance device 71 and the process transfer device 72, but the bag body conveyance device 71 and the process transfer device 72 may be driven by the same drive source. For example, by rotatably attaching both the process section transfer table 63 and the bag body conveyance table 64 to the rotation shaft of a single drive motor, the rotation of the process section transfer table 63 and the rotation of the bag body conveyance table 64 can be easily synchronized, and it is possible to synchronize the conveyance of bag bodies 100 and the transfer of hoppers 21.

Further, in the above-described embodiments, a case where the hoppers 21 are used as the bag body processing units has been described, but the bag processing units, which are sequentially arranged in the plurality of stations and are raised and lowered in synchronization with the conveyance of the bag bodies 100, are not limited to the hoppers 21. For example, a liquid filling nozzle, a gas blowing nozzle, a deaeration nozzle, or another packaging processing unit that performs various processes on bag bodies 100 may be provided as a bag processing unit instead of or in addition to the hoppers 21.

Further, in the above-described embodiments, the motor control unit that controls each of the conveyance drive motor 65 and the transfer drive motor 66, the motor control unit that controls the respective servomotors 53 of the first guide drive control unit 51 and the second guide drive control unit 52, and the tuning control unit that synchronizes the conveyance of bag bodies 100 and the transfer of the hoppers 21 are constituted by a single control unit 50 (see FIG. 4), but these motor control units and tuning control unit may be provided as separate bodies. In such a case, it is preferable that the motor control units and the tuning control unit provided as separate units be connected to each other and transmission and reception of various kinds of information data be performed therebetween. Further, the control unit for controlling each of these motor control units and the tuning control unit may be constituted by a single control device or a combination of a plurality of control devices.

Further, in the above-described embodiments, in the second station S2 to the third station S3, each roller unit 44 and each hopper 21 are lowered; however, the guide surfaces 43 (in particular, the first guide surface 43*a* and the second guide surface 43*b*) of the guide units 40, 41, 42 (in particular, the first cylindrical cam part 40*a* and the first auxiliary cam 41) may be configured in such a manner that each roller unit 44 and each hopper 21 are raised in this section. Similarly, the guide surfaces 43 (in particular, the fourth guide surface 43*d* and the fifth guide surface 43*e*) of the guide units 40, 41, 42 (in particular, the third cylindrical cam part 40*c* and the second auxiliary cam 42) may be configured in such a manner that each roller unit 44 and each hopper 21 are lowered in the sixth station S6 to the seventh station S7.

Further, in the above-described embodiments, the vertical position of each roller unit 44 stopped intermittently at the second station S2 and the vertical position of each roller unit 44 stopped intermittently at the seventh station S7 are the same as each other, but these vertical positions may be different from each other. Further, the vertical position at which each roller unit 44 is lowered and arranged in the third station S3 and the vertical position of each roller unit 44 immediately after having moved from the fifth station S5 to the sixth station S6 may be different from each other.

Further, in the above-described embodiments, the auxiliary cams (I.e., the first auxiliary cam 41 and the second auxiliary cam 42) are driven by the servomotors 53, but the auxiliary cams may be driven by another actuator such as an air cylinder.

Further, in the above-described embodiments, the stationary cylindrical cam 40 and the auxiliary cams provided movably (i.e., the first auxiliary cam 41 and the second auxiliary cam 42) are combined so that the raising and lowering of the roller units 44 and the hoppers 21 are performed, but the raising and lowering of the roller units 44 and the hoppers 21 may be carried out only by the auxiliary cams. Specifically, when the first height position is set at the raising end position and the second height position is set at the lowering end position and when a roller unit 44 and a hopper 21 are raised or lowered between the raising end position and the lowering end position, guide surfaces extending so as to vary from the first height position to the second height position may be formed in the auxiliary cams. In this case, by moving the auxiliary cams in a state in which a roller unit 44 is placed on the guide surfaces, it is possible to move the roller unit 44 between the raising end position and the lowering end position so as to raise or lower the hopper 21.

Further, in the above-described embodiments, the first auxiliary cam 41 (the second guide surface 43*b*) and the second auxiliary cam 42 (the fourth guide surface 43*d*) are moved in the horizontal direction, but the first auxiliary cam 41 (the second guide surface 43*b*) and the second auxiliary cam 42 (the fourth guide surface 43*d*) may be provided so as to be movable in a direction including a horizontal direction component.

Embodiments including components and/or methods other than the above-described components and/or methods may also be included in the embodiments of the present invention. Also, embodiments in which some elements of the above-described components and/or methods are not included may also be included in the embodiments of the present invention. Also, embodiments in which some components and/or methods included in a certain embodiment of the present invention and some components and/or methods included in another embodiment of the present invention are included may also be included in the embodiments of the present invention. Therefore, the components and/or methods included in the above-described embodiments and modifications and the components and/or methods included in embodiments of the present invention which are not described above may be combined, and embodiments based on such combinations may also be included in the embodiments of the present invention. Further, the effects of the present invention are not limited to the above-described effects, and specific effects depending on the specific configuration of each embodiment can be exerted. As described above, various additions, modifications and partial deletions may be made to each element described in the claims, description, abstract and drawings without departing from the technical idea and gist of the present invention.

The invention claimed is:

1. A conveyance mechanism comprising:

a bag body conveyance unit which conveys a bag body and sequentially disposes the bag body in a plurality of stations;

a process transfer unit which transfers a bag body processing unit installed with a roller unit in synchronization with conveyance of the bag body and sequentially disposes the bag body processing unit in the plurality of stations; and a guide unit having a guide surface on which the roller unit is placed and which determines positions of the roller unit and the bag body processing unit in a vertical direction, wherein:

the guide unit includes a first guide part and a second guide part, the first guide part having a first guide surface which extends from a first guide station towards a second guide station of the plurality of stations, the second guide part having a second guide surface which is disposed in the second guide station, while the process transfer unit transfers the bag body processing unit from the first guide station towards the second guide station, the roller unit is moved from on the first guide surface to on the second guide surface, the second guide surface extends so as to vary from a first height position to a second height position in the vertical direction, the second guide part is provided movably in a direction including a horizontal direction component in the second guide station, and while the bag body processing unit is disposed in the second guide station, the second guide part is moved from a first variation position to a second variation position in a state in which the roller unit is placed on the second guide surface in such a manner that the roller unit is moved from the first height position to the second height position.

2. The conveyance mechanism as defined in claim 1, wherein:

a movement speed of the second guide part is adjusted by a guide drive control unit, and the movement speed of the second guide part is determined according to at least a movement speed of the roller unit.

3. The conveyance mechanism as defined in claim 2, wherein:

the guide drive control unit includes: a servomotor which drives the second guide part; and a motor control unit which controls the servomotor, and the motor control unit controls the servomotor so as to cause the second guide part to move at the movement speed.

4. The conveyance mechanism as defined in claim 1, further comprising:

a conveyance drive unit which drives the bag body conveyance unit;

a transfer drive unit which is provided separately from the conveyance drive unit and drives the process transfer unit; and a tuning control unit which controls the conveyance drive unit and the transfer drive unit so as to synchronize conveyance of the bag body and transfer of the bag body processing unit.

5. The conveyance mechanism as defined in claim 2, further comprising:

a conveyance drive unit which drives the bag body conveyance unit;

a transfer drive unit which is provided separately from the conveyance drive unit and drives the process transfer unit; and a tuning control unit which controls the conveyance drive unit and the transfer drive unit so as to synchronize conveyance of the bag body and transfer of the bag body processing unit.

6. The conveyance mechanism as defined in claim 3, further comprising:

a conveyance drive unit which drives the bag body conveyance unit;

a transfer drive unit which is provided separately from the conveyance drive unit and drives the process transfer unit; and a tuning control unit which controls the conveyance drive unit and the transfer drive unit so as to synchronize conveyance of the bag body and transfer of the bag body processing unit.

7. The conveyance mechanism as defined in claim 1, wherein, in a state in which at least a part of the bag body processing unit is positioned above the bag body, the process transfer unit intermittently transfers the bag body processing unit and stops the bag body processing unit in each of the plurality of stations.

8. The conveyance mechanism as defined in claim 2, wherein, in a state in which at least a part of the bag body processing unit is positioned above the bag body, the process transfer unit intermittently transfers the bag body processing unit and stops the bag body processing unit in each of the plurality of stations.

9. The conveyance mechanism as defined in claim 3, wherein, in a state in which at least a part of the bag body processing unit is positioned above the bag body, the process transfer unit intermittently transfers the bag body processing unit and stops the bag body processing unit in each of the plurality of stations.

10. The conveyance mechanism as defined in claim 1, wherein:

the bag body conveyance unit conveys the bag body along a circular path, and the plurality of stations are provided along the circular path.

11. The conveyance mechanism as defined in claim 2, wherein:

the bag body conveyance unit conveys the bag body along a circular path, and the plurality of stations are provided along the circular path.

12. The conveyance mechanism as defined in claim 3, wherein:

the bag body conveyance unit conveys the bag body along a circular path, and the plurality of stations are provided along the circular path.

13. The conveyance mechanism as defined in claim 10, wherein:

the bag body conveyance unit conveys a plurality of bag bodies, number of the plurality of bag bodies being same as number of the plurality of stations, the process transfer unit transfers a plurality of bag body processing units and a plurality of roller units, number of the plurality of bag body processing units being same as number of the plurality of stations, number of the plurality of roller units being same as number of the plurality of stations.

14. The conveyance mechanism as defined in claim 11, wherein:

the bag body conveyance unit conveys a plurality of bag bodies, number of the plurality of bag bodies being same as number of the plurality of stations, the process transfer unit transfers a plurality of bag body processing units and a plurality of roller units, number of the plurality of bag body processing units being same as number of the plurality of stations, number of the plurality of roller units being same as number of the plurality of stations.

15. The conveyance mechanism as defined in claim 12, wherein:

the bag body conveyance unit conveys a plurality of bag bodies, number of the plurality of bag bodies being same as number of the plurality of stations, the process transfer unit transfers a plurality of bag body processing units and a plurality of roller units, number of the plurality of bag body processing units being same as number of the plurality of stations, number of the plurality of roller units being same as number of the plurality of stations.

16. The conveyance mechanism as defined in claim 1, wherein:

the first guide surface extends from the first guide station towards the second guide station so as to vary in the vertical direction from a third height position to the first height position which is between the third height position and the second height position, and while the process transfer unit transfers the bag body processing unit from the first guide station to the second guide station, the roller unit is placed on the first guide surface and is moved from the third height position towards the first height position, and is placed on a part of the second guide surface which is located at the first height position in the second guide station.

17. The conveyance mechanism as defined in claim 2, wherein:

the first guide surface extends from the first guide station towards the second guide station so as to vary in the vertical direction from a third height position to the first height position which is between the third height position and the second height position, and while the process transfer unit transfers the bag body processing unit from the first guide station to the second guide station, the roller unit is placed on the first guide surface and is moved from the third height position towards the first height position, and is placed on a part of the second guide surface which is located at the first height position in the second guide station.

18. The conveyance mechanism as defined in claim 3, wherein:

the first guide surface extends from the first guide station towards the second guide station so as to vary in the vertical direction from a third height position to the first height position which is between the third height position and the second height position, and while the process transfer unit transfers the bag body processing unit from the first guide station to the second guide station, the roller unit is placed on the first guide surface and is moved from the third height position towards the first height position, and is placed on a part of the second guide surface which is located at the first height position in the second guide station.

19. The conveyance mechanism as defined in claim 16, wherein:

the guide unit includes a third guide part having a third guide surface, a fourth guide part having a fourth guide surface, and a fifth guide part having a fifth guide surface, the third guide surface has the second height position in the vertical direction from the second guide station towards the third guide station among the plurality of stations, the fourth guide surface is disposed in the third guide station and extends so as to vary in the vertical direction from the second height position to a fourth height position which is between the third height position and the second height position, the fifth guide surface extends from a fourth guide station towards the third guide station of the plurality of stations so as to vary from the third height position to the fourth height position in the vertical direction, the fourth guide part is provided movably in a direction including a horizontal direction component in the third guide station, while the process transfer unit transfers the bag body processing unit from the second guide station towards the third guide station, the roller unit is moved from on the second guide surface to on the third guide surface, while the bag processing unit is disposed in the third guide station, the fourth guide part is moved from a third variation position to a fourth variation position in a state in which the roller unit disposed in the second height position is placed on the fourth guide surface, so that the roller unit is moved from the second height position to the fourth height position, and while the process transfer unit transfers the bag body processing unit from the third guide station to the fourth guide station, the roller unit is moved from on the fourth guide surface to on the fifth guide surface so as to move the roller unit from the fourth height position to the third height position.

20. The conveyance mechanism as defined in claim 17, wherein:

the guide unit includes a third guide part having a third guide surface, a fourth guide part having a fourth guide surface, and a fifth guide part having a fifth guide surface, the third guide surface has the second height position in the vertical direction from the second guide station towards the third guide station among the plurality of stations, the fourth guide surface is disposed in the third guide station and extends so as to vary in the vertical direction from the second height position to a fourth height position which is between the third height position and the second height position, the fifth guide surface extends from a fourth guide station towards the third guide station of the plurality of stations so as to vary from the third height position to the fourth height position in the vertical direction, the fourth guide part is provided movably in a direction including a horizontal direction component in the third guide station, while the process transfer unit transfers the bag body processing unit from the second guide station towards the third guide station, the roller unit is moved from on the second guide surface to on the third guide surface, while the bag processing unit is disposed in the third guide station, the fourth guide part is moved from a third variation position to a fourth variation position in a state in which the roller unit disposed in the second height position is placed on the fourth guide surface, so that the roller unit is moved from the second height position to the fourth height position, and while the process transfer unit transfers the bag body processing unit from the third guide station to the fourth guide station, the roller unit is moved from on the fourth guide surface to on the fifth guide surface so as to move the roller unit from the fourth height position to the third height position.

21. The conveyance mechanism as defined in claim 18, wherein:

the guide unit includes a third guide part having a third guide surface, a fourth guide part having a fourth guide surface, and a fifth guide part having a fifth guide surface, the third guide surface has the second height position in the vertical direction from the second guide station towards the third guide station among the plurality of stations, the fourth guide surface is disposed in the third guide station and extends so as to vary in the vertical direction from the second height position to a fourth height position which is between the third height position and the second height position, the fifth guide surface extends from a fourth guide station towards the third guide station of the plurality of stations so as to vary from the third height position to the fourth height position in the vertical direction, the fourth guide part is provided movably in a direction including a horizontal direction component in the third guide station, while the process transfer unit transfers the bag body processing unit from the second guide station towards the third guide station, the roller unit is moved from on the second guide surface to on the third guide surface, while the bag processing unit is disposed in the third guide station, the fourth guide part is moved from a third variation position to a fourth variation position in a state in which the roller unit disposed in the second height position is placed on the fourth guide surface, so that the roller unit is moved from the second height position to the fourth height position, and while the process transfer unit transfers the bag body processing unit from the third guide station to the fourth guide station, the roller unit is moved from on the fourth guide surface to on the fifth guide surface so as to move the roller unit from the fourth height position to the third height position.

* * * * *